US008790184B2

(12) United States Patent
Kruglick

(10) Patent No.: US 8,790,184 B2
(45) Date of Patent: Jul. 29, 2014

(54) RESOURCE MANAGEMENT FOR DATA CENTER BASED GAMING

(75) Inventor: Ezekiel Kruglick, Poway, CA (US)

(73) Assignee: Empire Technology Development LLC, Wilmington, DE (US)

( * ) Notice: Subject to any disclaimer, the term of this patent is extended or adjusted under 35 U.S.C. 154(b) by 91 days.

(21) Appl. No.: 13/634,502

(22) PCT Filed: Mar. 29, 2012

(86) PCT No.: PCT/US2012/031298
§ 371 (c)(1),
(2), (4) Date: Sep. 12, 2012

(87) PCT Pub. No.: WO2013/147812
PCT Pub. Date: Oct. 3, 2013

(65) Prior Publication Data
US 2013/0260891 A1 Oct. 3, 2013

(51) Int. Cl.
*A63F 9/24* (2006.01)

(52) U.S. Cl.
USPC ..... 463/42

(58) Field of Classification Search
IPC ..... A63F 9/24
See application file for complete search history.

(56) References Cited

U.S. PATENT DOCUMENTS

| | | | |
|---|---|---|---|
| 2007/0133603 | A1 | 6/2007 | Weaver et al. |
| 2008/0189718 | A1 | 8/2008 | Gulley et al. |
| 2009/0318232 | A1 | 12/2009 | Harris et al. |
| 2010/0049852 | A1 | 2/2010 | Whitnah et al. |
| 2010/0248843 | A1 | 9/2010 | Karsten |
| 2011/0217681 | A1 | 9/2011 | Krejcarek |

OTHER PUBLICATIONS

International Search Report and Written Opinion for PCT/2012/031298 Filed Mar. 29, 2012, Mailed Jun. 22, 2012.

Raid—Wikipedia, the free encyclopedia, Retrieved from "http://en.wikipedia.org/w/index.php?title=Raid&oldid=487750538" Categories: Disambiguation pages, This page was last modified on Apr. 16, 2012 at 23:24.

*Primary Examiner* — Omkar Deodhar
(74) *Attorney, Agent, or Firm* — Turk IP Law, LLC

(57) ABSTRACT

Technologies are presented for managing a resource demand on a data center providing game services by adjusting a probability of various kinds of game events. Data center load data may be received and used to adjust occurrence tables associated with both one-off and lengthy game events that may direct game clients toward events that may involve lesser resource demand. Contrary to conventional load balancing for non-gaming applications, the methods described herein may take advantage of the pseudorandom event nature that may be a part of a game experience in gaming applications. The resource demand may be altered without changing the number of customers served or the quality of service provided. Thus, resource management may be enhanced while serving the same number of customers.

20 Claims, 8 Drawing Sheets

100

RESOURCE MANAGEMENT FOR DATA CENTER BASED GAMING

BACKGROUND

Unless otherwise indicated herein, the materials described in this section are not prior art to the claims in this application and are not admitted to be prior art by inclusion in this section.

Data center infrastructure management (DCIM) systems may be of interest in the management of resources at data centers. Such DCIM systems may include load balancing and optimizing to serve the demand, as well as perhaps delaying some data-center owned processes that may be delay-tolerant. Such DCIM systems may aim to provide a consistent and/or predictable user experience for many user facing applications such as business applications, communications applications, webpage applications having a data center backend, and the like. Data center games, however, may differ from other user facing applications in that any given user experience may be purposely designed to include game elements or behaviors that may be unpredictable, surprising, variable, or the like.

The present disclosure appreciates that management of resources for data center games may be a challenging endeavor.

SUMMARY

The present disclosure generally describes technologies for managing resources for data center games.

According to some examples, a method for managing data center resources for a game service is provided. The method may include: deploying a game service for multiple game clients; providing a sequence of game events to one or more game clients based on a probability of occurrence for each of the game events in the sequence; determining a resource demand on a data center infrastructure due to the deployed game service; and if the resource demand is above a predefined resource threshold, modifying the probability of occurrence for at least one of the game events such that the sequence of game events may be modified to reduce the resource demand.

According to various examples, a data center configured to deploy one or more game services for multiple game clients is provided. The data center may include a management server configured to monitor a data center infrastructure and determine a resource demand on the data center infrastructure. The data center may also include at least one server. The at least one server may be configured to: deploy a game service; provide a sequence of game events to one or more game clients based on a probability of occurrence for each of the game events in the sequence; receive an alert from the management server if the resource demand is above a predefined resource threshold; and modify the probability of occurrence for at least one of the game events if the resource demand is above a predefined resource threshold such that the sequence of game events may be modified to reduce the resource demand.

According to further examples, a computer-readable storage medium having instructions stored thereon for managing data center resources for a game service is provided. The instructions may include: deploying a game service for multiple game clients; providing a sequence of game events to one or more game clients based on a probability of occurrence for each of the game events in the sequence; determining a resource demand on a data center infrastructure due to the deployed game service; and if the resource demand is above a predefined resource threshold, modifying the probability of occurrence for at least one of the game events such that the sequence of game events may be modified to reduce the resource demand.

According to some examples, a game vendor server configured to deploy a game service for multiple game clients is provided. The game vendor server may include a memory configured to store instructions. The game vendor server may also include a processor configured to execute a game application in conjunction with the instructions stored in the memory. The game application may be configured to: provide a sequence of game events to one or more game clients based on a probability of occurrence for each of the game events in the sequence; monitor a resource demand server due to the deployed game service; and if the resource demand is above a predefined resource threshold: modify the probability of occurrence for at least one of the game events, incentivize a game client to select a game event in the sequence, and/or move a game client to a different game instance, such that the resource demand may be reduced while preserving a pseudo-random nature of the sequence of game events.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1A:
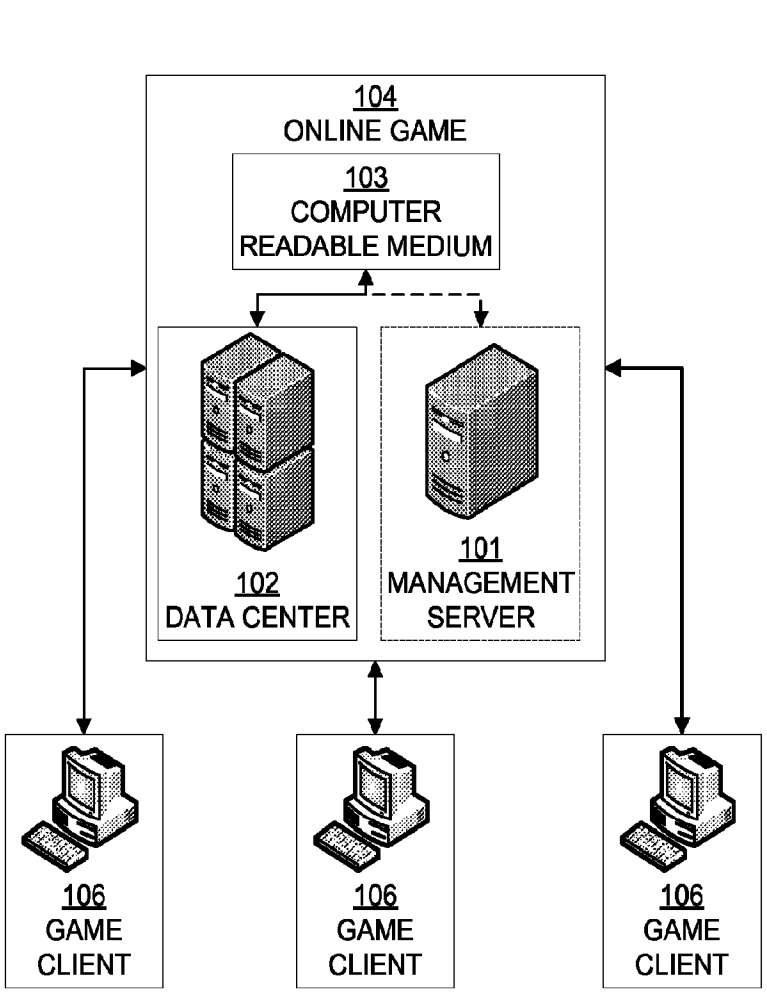
FIG. 1A is a conceptual illustration of an example online gaming environment.

all arranged in accordance with at least some embodiments described herein.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to methods, apparatus, systems, devices, and/or computer program products related to resource management in data center based gaming.

Briefly stated, technologies are presented for managing a resource demand on a data center providing game services by adjusting a probability of various kinds of game events. Data center load data may be received and used to adjust occurrence tables associated with both one-off and lengthy game events that may direct game clients toward events that may involve lesser resource demand. Contrary to conventional load balancing for non-gaming applications, the techniques described herein may take advantage of the pseudorandom event nature that may be a part of a game experience in gaming applications. The resource demand may be altered without changing the number of customers served or a quality of service provided. Thus, resource management may be enhanced while serving the same number of customers.

FIG. 1A is a conceptual illustration of an example online gaming environment 100, arranged in accordance with at least some embodiments described herein. A data center 102 may deploy a game service 104 for multiple game clients 106. The data center 102 may be implemented in any suitable configuration, for example, using a server farm, a grid computing system, a computing cluster, a parallel cluster, a cloud computing center, a mainframe, or the like. The data center 102 may be self-managed or may include an optional management server 101. While deploying the game service 104 for the game clients 106, the data center 102 may implement a method stored on a computer readable medium 103 for managing data center resources for the game service 104, such as an example method 120, described in FIG. 1B, or an example method 140, described in FIG. 1C.

Figure 1B:
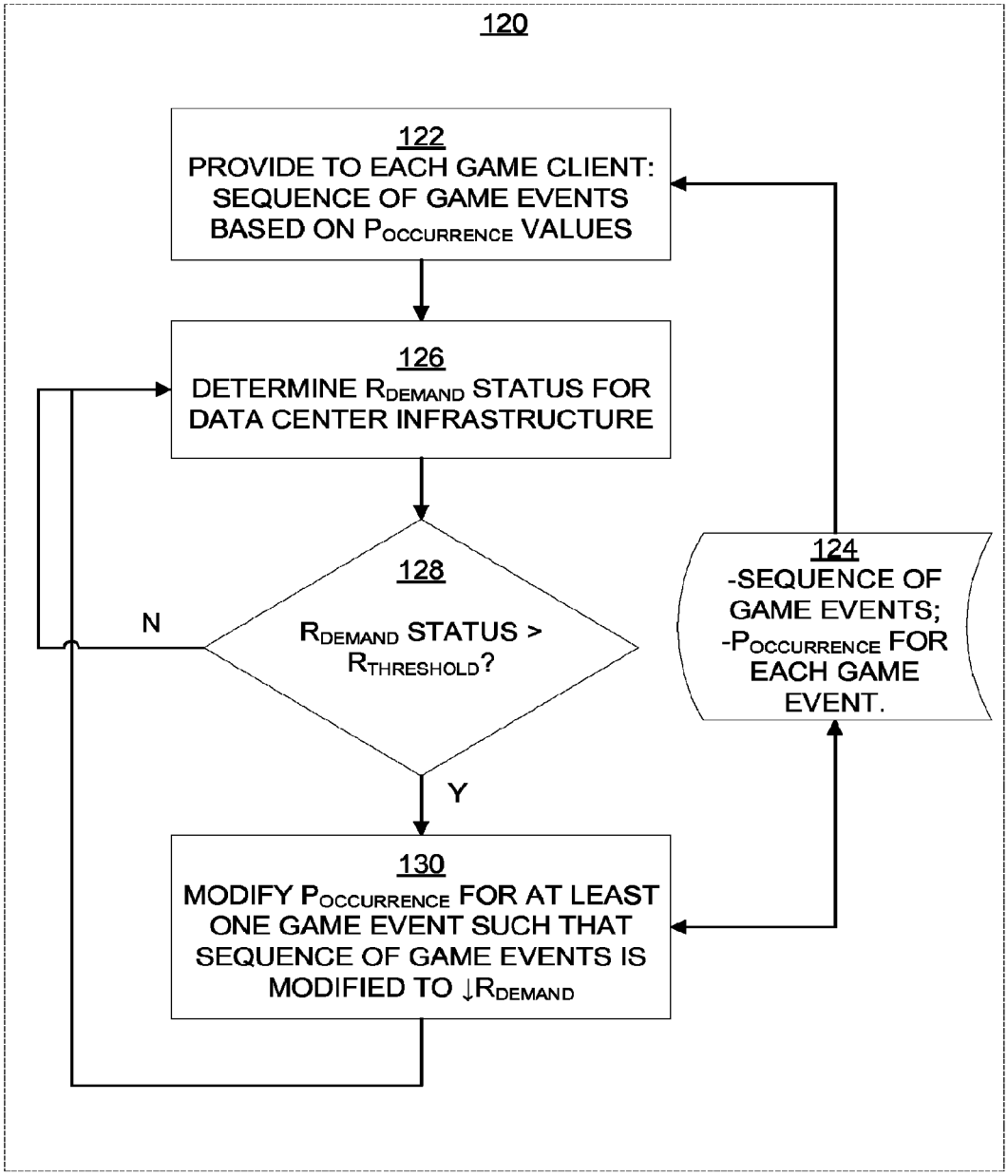
FIG. 1B is a flow diagram illustrating an example method for managing data center resources for a game service.

FIG. 1B is a flow diagram illustrating an example method 120 for managing data center resources for a game service, that may be performed by a computing device such as one of the servers of the data center 102 or the optional management server 101, arranged in accordance with at least some embodiments described herein. Example methods may include one or more operations, functions or actions as illustrated by blocks 122, 124, 126, 128, and/or 130. The operations described in the blocks 122 through 130 may also be stored as computer-executable instructions in a computer-readable medium such as the computer-readable medium 103 coupled to a computing device.

The example method 120 may begin with block 122 where a sequence of game events is provided to one or more of the game clients 106 based on a probability of occurrence $P_{OCCURRENCE}$ for each of the game events in the sequence. Collectively, the sequence of game events based on the probability of occurrence $P_{OCCURRENCE}$ for each of the game events in the sequence may be stored, e.g., in a dynamic table of occurrences 124. Block 122 may be followed by block 126.

At block 126, a resource demand $R_{DEMAND}$ on the data center 102 due to the deployed game service 104 may be determined. The resource demand $R_{DEMAND}$ may be self-determined by the data center 102 or may be determined by the optional management server 101. Block 126 may be followed by block 128, where the resource demand $R_{DEMAND}$ is compared to a predefined resource threshold $R_{THRESHOLD}$. If the resource demand $R_{DEMAND}$ is above the predefined resource threshold $R_{THRESHOLD}$, block 128 may be followed by block 130, where the probability of occurrence $P_{OCCURRENCE}$ is modified for at least one of the game events such that the sequence of game events is modified to reduce the resource demand $R_{DEMAND}$. Block 130 may then be followed by block 126. If the resource demand $R_{DEMAND}$ is not above (e.g., below) the predefined resource threshold $R_{THRESHOLD}$, block 128 may be followed by block 126, where the resource demand $R_{DEMAND}$ on the data center 102 due to the deployed game service 104 is determined. In some examples, the example method 120 may include maintaining the dynamic table of occurrences 124 for indexing game events to probabilities of occurrence.

Figure 1C:
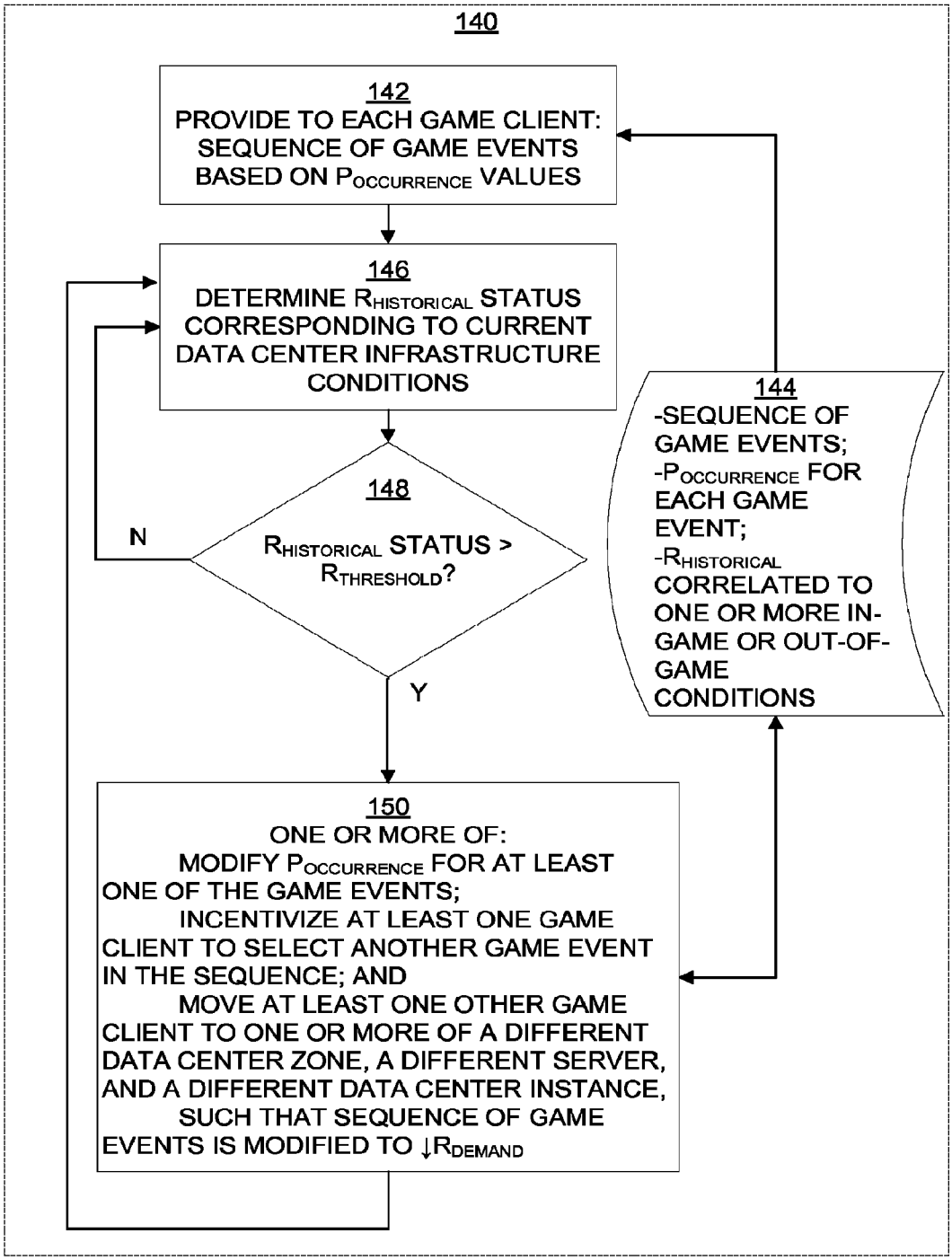
FIG. 1C is a flow diagram illustrating an example method for managing data center resources for a game service.

FIG. 1C is a flow diagram illustrating the example method 140 for managing data center resources for a game service, that may be performed by a computing device such as one of the servers of the data center 102 or the optional management server 101, arranged in accordance with at least some embodiments described herein. Example methods may include one or more operations, functions or actions as illustrated by blocks 142, 144, 146, 148, and/or 150. The operations described in the blocks 142 through 150 may also be stored as computer-executable instructions in a computer-readable medium such as a computer-readable medium 103 coupled to a computing device. The example method 140 may begin with block 142, where a sequence of game events may be provided to one or more of the game clients 106 by the game service based on the probability of occurrence $P_{OCCURRENCE}$ for each of the game events in the sequence. A historical resource demand $R_{HISTORICAL}$ may be correlated to one or more in-game or out-of-game conditions such that knowledge of the in-game or out-of-game condition permits predicting or estimating current or future resource demand as the historical resource demand $R_{HISTORICAL}$. Collectively, the sequence of game events based on the probability of occurrence $P_{OCCURRENCE}$ and the historical resource demand $R_{HISTORICAL}$ may be stored, e.g., in a dynamic table of occurrences 144. Block 142 may be followed by block 146, where the historical resource demand $R_{HISTORICAL}$ may be determined on the data center 102 due to the deployed game service 104 that corresponds to current or expected in-game or out-of-game conditions. The historical resource demand $R_{HISTORICAL}$ may be self-determined by the data center 102 or may be determined by the optional management server 101.

Block 146 may be followed by block 148, where whether the historical resource demand $R_{HISTORICAL}$ is above the predefined resource threshold $R_{THRESHOLD}$ is determined. If the historical resource demand $R_{HISTORICAL}$ is above the predefined resource threshold $R_{THRESHOLD}$, block 148 may be followed by block 150, where the probability of occurrence $P_{OCCURRENCE}$ for at least one of the game events may be modified, at least one game client may be incentivized to select another game event in the sequence, and/or at least one other game client may be moved, such that the resource demand is reduced. If the historical resource demand $R_{HISTORICAL}$ is not above (e.g., below) the predefined resource threshold $R_{THRESHOLD}$, block 148 may be followed by block 146, where the historical resource demand $R_{HISTORICAL}$ is determined on the data center 102 due to the deployed game service 104. In some examples, the example method 140 may include maintaining the dynamic table of occurrences 144 for indexing game events to probabilities of occurrence. On some occasions resource demand may exceed $R_{THRESHOLD}$, for example, when $P_{OCCURRENCE}$ has been changed but has not had time to take effect, or when players do unpredicted things. The game client may be incentivized by the game service operator and/or the data center by changing the probability of occurrence.

As used herein, the "resource demand" value, such as $R_{DEMAND}$, may represent one or more resources of the data center 102. For example, the resource demand $R_{DEMAND}$ may be determined based on consumption of: a memory allocation, a data storage capacity, a processing capacity, a network bandwidth, a cooling capacity, and/or a power capacity, or the like. As used herein, the "historical resource demand" value, such as $R_{HISTORICAL}$, may represent a resource demand recorded from previous game play and may be correlated to one or more in-game or out-of-game conditions. Examples of in-game conditions, which may be correlated with $R_{HISTORICAL}$ include game client load, game play history, or the like. Examples of out-of-game conditions, which may be correlated with $R_{HISTORICAL}$ include time of day; day of week; whether a day is a holiday, a weekend day, or another day that may correlate to a change in the number of active game clients; geographical distribution of game clients; network congestion conditions; current or recent game sales; occurrence of out-of-game public events or media displays that may be correlated to the game, such as a companion television show; or the like. Other examples of out-of-game conditions may also include one or more other recorded resource demands such as the memory allocation, the data storage capacity, the processing capacity, the network bandwidth, the cooling capacity, and the power capacity, or the like. In some embodiments, $R_{HISTORICAL}$ may be a combination of multiple historical resource demand values. For example, $R_{HISTORICAL}$ may be for a combination of a number of players and computed based on applied $P_{OCCURRENCE}$ for each player.

As used herein, a "predefined resource threshold" such as $R_{THRESHOLD}$ represents a level of demand on one or more of the resources of the data center 102, which triggers the modifying the probability of occurrence $P_{OCCURRENCE}$ described above in conjunction with block 130. The "predefined resource threshold" may represent the resources of the data center 102 separately or collectively. For example, the predefined resource threshold may include individual threshold values for each of the one or more resources and/or an overall threshold value that depends on the collective value of two or more of the resources. In some examples, the predefined resource threshold may be a computed score. For example, specific implementations of individual threshold values, collective threshold values, variation in threshold values as a function of time of day or other variables, etc. may be computed according to the needs and configuration of a specific data center and its clients.

Each "game event" is any occurrence within the online game, which may be perceived as unpredictable as received by the game client. The "sequence of game events" may be any series of occurrences within the online game, which may occur as determined by the "probability of occurrence" as modulated by game play. As used herein, the "probability of occurrence" value, such as $P_{OCCURRENCE}$, may represent the chance of occurrence for any particular game event or sequence of game events. In various examples, the game events may be distinguished by: a different game location, a different game time, a different game scenario, and/or a different subset of participating game clients.

In various examples, modifying the probability of occurrence $P_{OCCURRENCE}$ for at least one of the game events such that the sequence of game events may be modified to reduce the resource demand $R_{DEMAND}$ may be substantially undetectable to the game clients. For example, a game player at one of the game clients may experience game play without being aware that the probability of occurrence of any particular game event has changed or that the sequence of game events has changed.

In various examples, modifying the probability of occurrence may include or may result in preserving a pseudorandom nature of the sequence of game events when modifying the sequence. For example, a variance in expected game behavior resulting from the modification to the series of game events may be perceived by a game player at a game client as normal variation that may be expected within game play.

In some examples, modifying the probability of occurrence (by the game service and/or the data center) may include encouraging or incentivizing a game client to select a game event in the sequence such that the resource demand is reduced as a result of the selection. For example, one of the game events may be a decision point in the game for the game player. The game player may have the option of selecting between two or more options, such as which door to open among two or more doors. One such option may represent a lower resource demand, and another such option may represent a higher resource demand. The game player at the game client may be incentivized or encouraged to select the option representing the lower resource demand through: an in-game reward, an in-game penalty, an out-of-game reward, an out-of game-penalty, a game objective, a game scenario, a game play indicator, a game congestion indicator, and/or an inter-player communication. For example, the player may be rewarded for selecting the option representing the lower resource demand via in-game rewards such: score points; experience points; game items; game monetary units; character abilities; opportunities to experience rare game events or game scenarios not offered as part of standard game play; chances to win other in-game rewards; or the like.

The player may also be penalized for selecting the option representing the higher resource demand by taking away in-game rewards. In another example, the game player at the game client may be incentivized or encouraged by the game service and/or the data center to select the option representing the lower resource demand by an offer of out-of-game rewards, such as: a discount on game pricing; a discount on products or services which facilitate game play such as a coupon for a game controller or a discount on airtime for game play over a mobile network; a discount on an out-of-game product or service; chances to win other out-of-game rewards; or the like. The player may also be penalized for selecting the option representing the higher resource demand by taking away out-of-game rewards or by increasing out-of-game costs, for example, charging a higher game fee for game play at a time of high game center resource demand.

Figure 2:
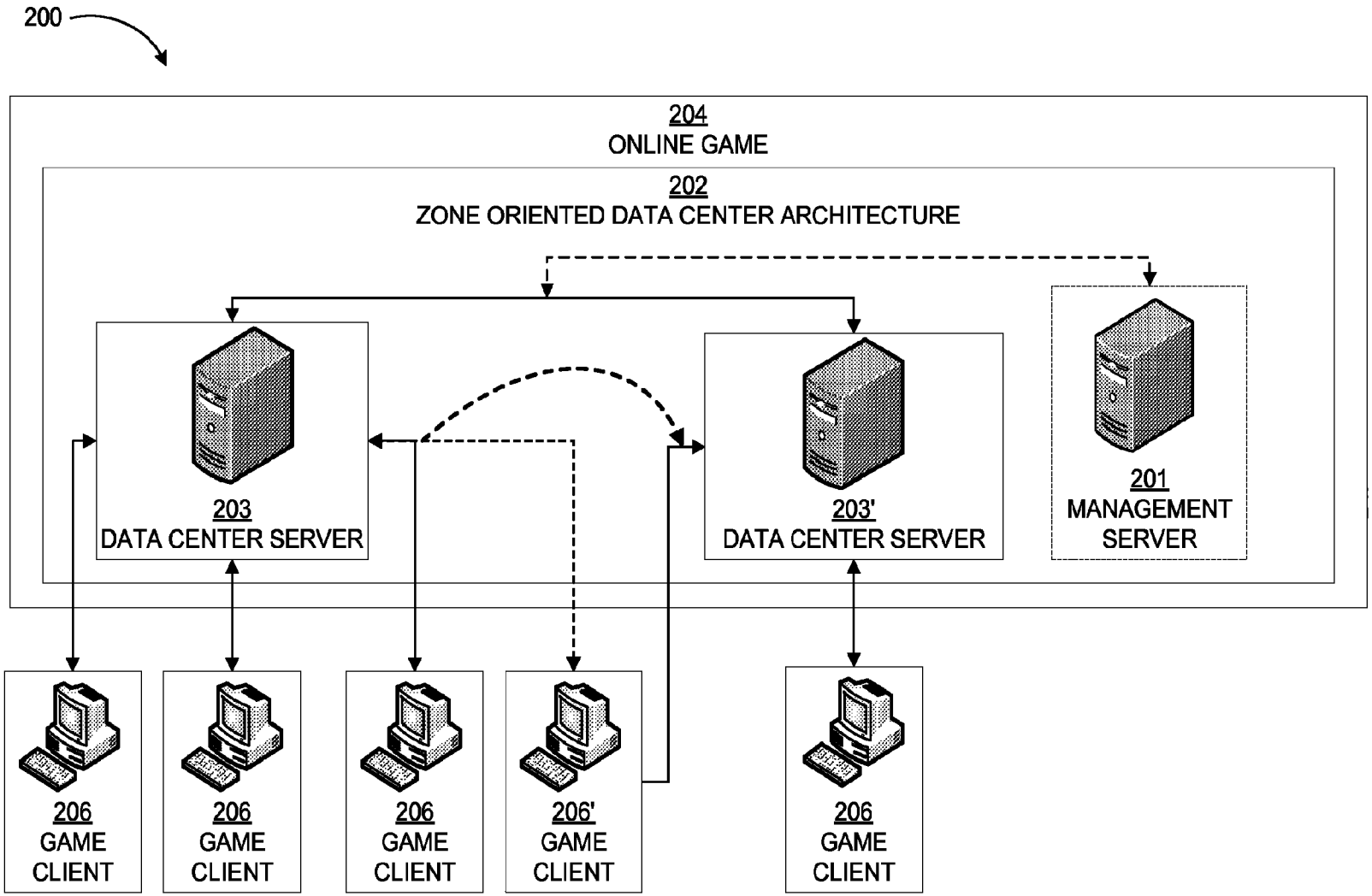
FIG. 2 is a conceptual illustration of an example data center based gaming system configured in a zone-oriented architecture.

In some examples, if the resource demand $R_{DEMAND}$ is above the predefined resource threshold $R_{THRESHOLD}$, at least one game client may be moved to a different data center zone, a different server, and/or a different data center instance. For example, FIG. 2 is a conceptual illustration of an example online gaming environment 200, arranged in accordance with at least some embodiments described herein. A data center 202 configured in a zone-oriented architecture may employ multiple servers 203 and 203' to deploy a game service 204 for multiple game clients 206 and 206'. The data center 202 may be self-managed or may include an optional management server 201. While deploying the game service 204 for the game clients 206 and 206', the data center 202 may implement any of the example methods 120 or 140 for managing data center resources.

Further, the data center 200 may employ servers 203 and 203' to act as different data center zones, different servers, different data center instances, or the like. For example, FIG. 2 illustrates that the server 203 has four game clients 206 and 206' and the server 203' has one game client 206. In some examples, the predefined resource threshold may represent a game client load on each server. If the resource demands of the four game clients 206 and 206' exceed the predefined game client load threshold, one or more of the game clients, e.g., the game client 206', may be moved to a different server, e.g., the server 203' as symbolized by the curved dashed arrow in FIG. 2. In various examples, the management server 201 may be configured to determine a first resource demand for a first server (e.g., the server 203) and a second resource demand for a second server (e.g. the server 203'); and if the first resource demand exceeds the second resource demand, the management server 201 may modify the probability of occurrence for at least one of the game events such that the sequence shifts from the first server 203 to the second server 203'.

In some examples, the differences between servers 203 and 203' may be substantially undetectable to the game players and the game clients 206 and 206'. In other examples, the differences between the servers 203 and 203' may be implemented as variations visible to the game players and the game clients 206 and 206', such as different in-game locations, different in-game scenarios, different collections of game clients 206 and 206', and the like.

Moreover, the data center 200 may be implemented with any suitable configuration of the servers 203 and 203', for example, in the form of a server farm, a grid computing system, a computing cluster, a parallel cluster, a cloud computing center, data center instances within a server farm, a grid computing system, a computing cluster, a parallel cluster, a cloud computing center, a mainframe, or the like.

Figure 3:
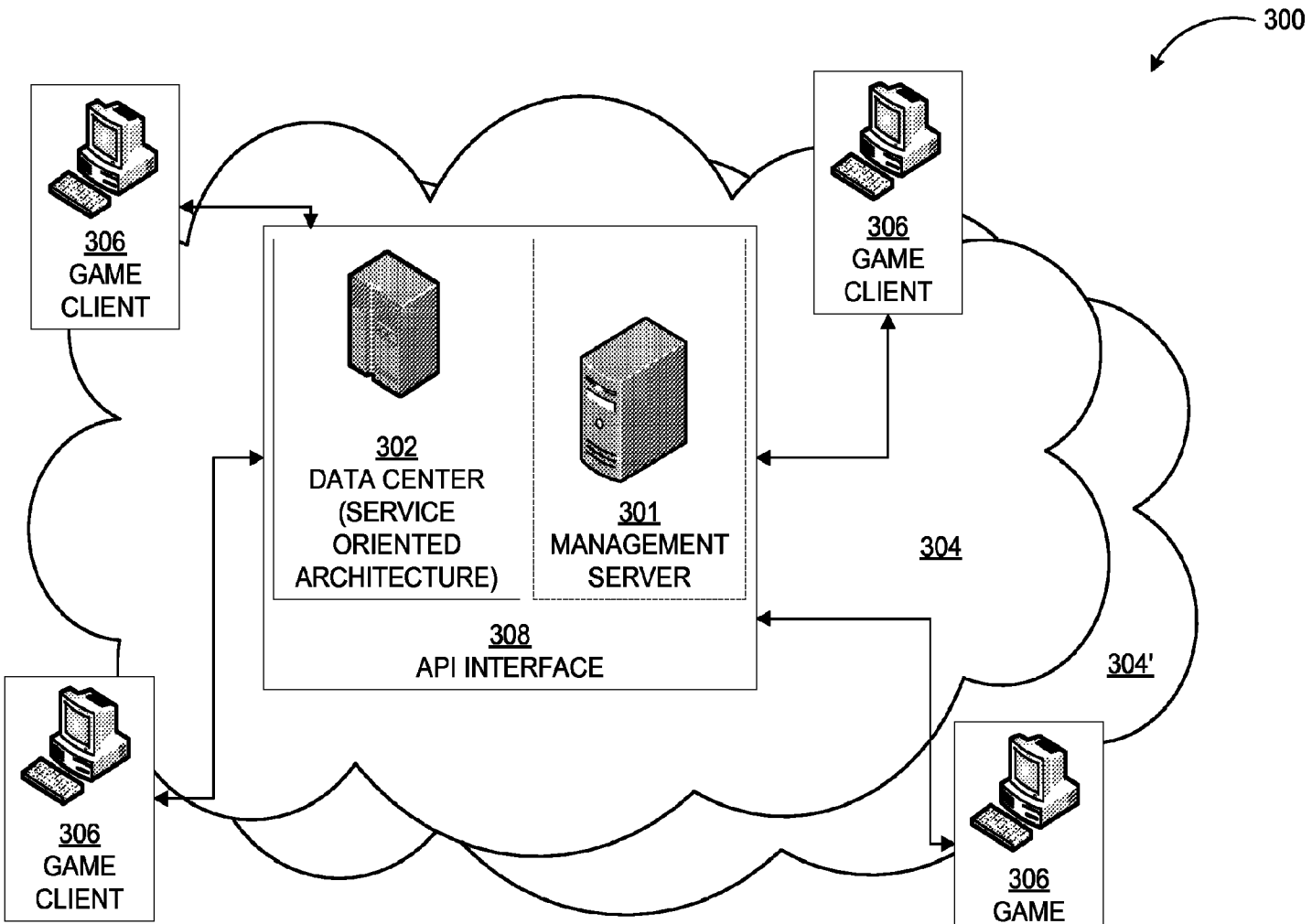
FIG. 3 is a conceptual illustration of an example data center based gaming system configured in a service-oriented architecture.

FIG. 3 is a conceptual illustration of an example game vendor server system 300 that includes at least one data center 302 configured in a service-oriented architecture, arranged in accordance with at least some embodiments described herein. The data center 302 may be configured to deploy multiple game services 304, 304', etc. from multiple game vendors for game clients 306. The data center 302 may be self-managed or may include an optional management server 301. The data center 302 may be further configured to employ an event occurrence application programming interface (API) 308 to modify the probability of occurrence $P_{OCCURRENCE}$. In some examples, the management server 301 may be further configured to provide incentives to the game vendors to provide the event occurrence API 308 and multiple game sequence options associated with different levels of resource consumption. In various examples, the management server 301 may be further configured to enable the game vendors to update the event occurrence API 308 in order to provide probabilities of occurrence $P_{OCCURRENCE}$ for additional game events.

Figure 4:
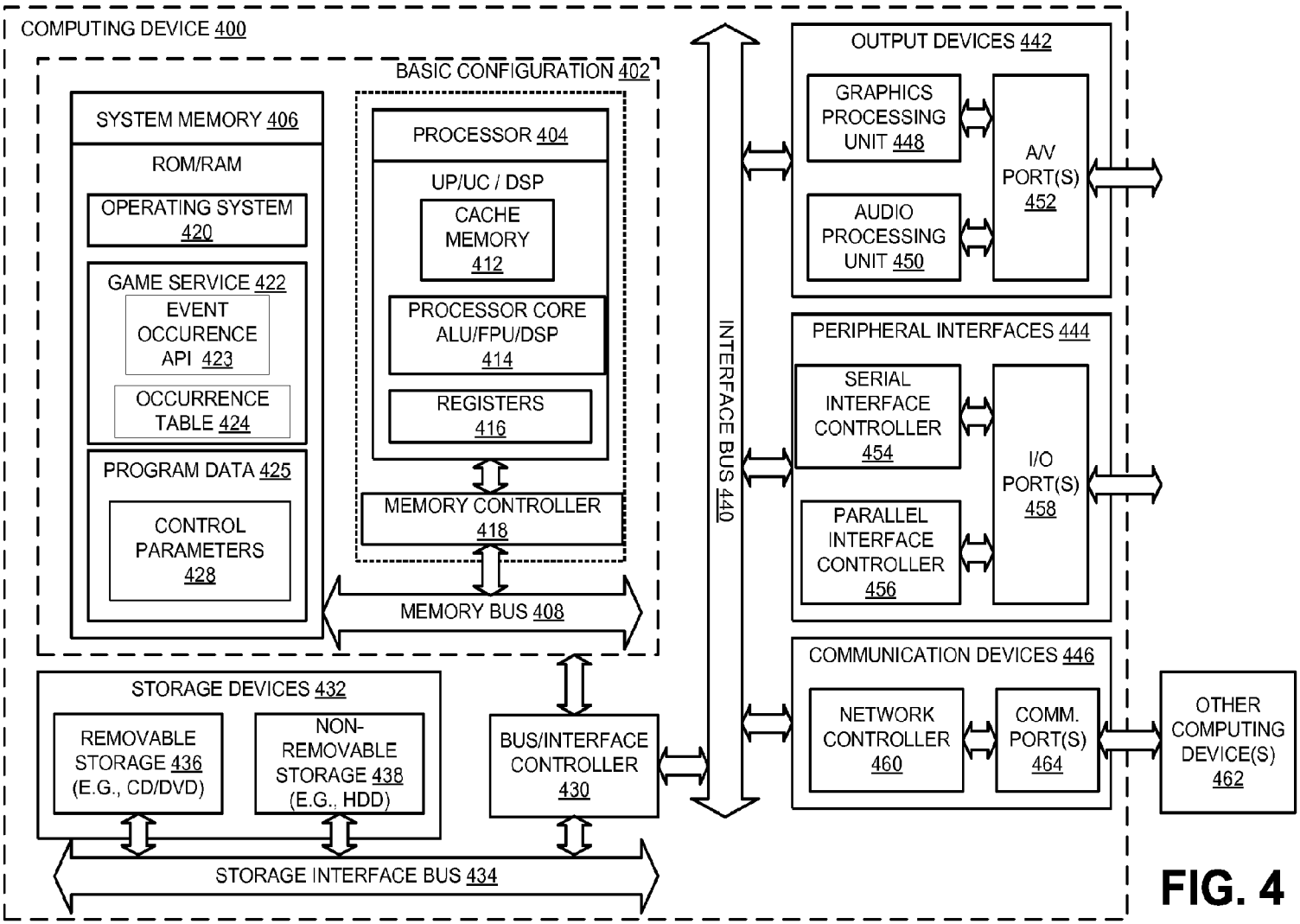
FIG. 4 is a conceptual illustration of a general purpose computing device, which may be used to implement example methods of resource management in data center based gaming.

FIG. 4 is a block diagram of a general purpose computing device 400, which may be used for managing data center resources for a game service and/or deploying the game service, arranged in accordance with at least some embodiments described herein. In an example basic configuration 402, the computing device 400 may include one or more processors 404 and a system memory 406. A memory bus 408 may be used for communicating between the processor 404 and the system memory 406. The basic configuration 402 is illustrated in FIG. 4 by those components within the inner dashed line.

Depending on the desired configuration, the processor 404 may be of any type, including but not limited to a microprocessor (μP), a microcontroller (μC), a digital signal processor (DSP), or any combination thereof. The processor 404 may include one more levels of caching, such as a level cache memory 412, a processor core 414, and registers 416. The example processor core 414 may include an arithmetic logic unit (ALU), a floating point unit (FPU), a digital signal processing core (DSP Core), or any combination thereof. An example memory controller 418 may also be used with the processor 404, or in some implementations the memory controller 418 may be an internal part of the processor 404.

Depending on the desired configuration, the system memory 406 may be of any type including but not limited to volatile memory (such as RAM), non-volatile memory (such as ROM, flash memory, etc.) or any combination thereof. The system memory 406 may include an operating system 420, one or more game service applications 422, and program data 425. The game service applications 422 may include an event occurrence API 423, which may modify the probability of occurrence $P_{OCCURRENCE}$ in service-oriented architecture configurations as described herein. The game service applications 422 may also include an occurrence table 424 for the sequence of game events, $P_{OCCURRENCE}$ for each game event, $R_{HISTORICAL}$ correlated to one or more in-game or out-of-game conditions, and the like. The program data 425 may include, among other data, one or more control parameters 428 such as parameters for modifying $P_{OCCURRENCE}$, providing an incentive to a game client, moving one game client, or the like, as described herein.

The computing device 400 may have additional features or functionality, and additional interfaces to facilitate communications between the basic configuration 402 and any desired devices and interfaces. For example, a bus/interface controller 430 may be used to facilitate communications between the basic configuration 402 and one or more data storage devices 432 via a storage interface bus 434. The data storage devices 432 may be one or more removable storage devices 436, one or more non-removable storage devices 438, or a combination thereof. Examples of the removable storage and the non-removable storage devices include magnetic disk devices such as flexible disk drives and hard-disk drives (HDD), optical disk drives such as compact disk (CD) drives or digital versatile disk (DVD) drives, solid state drives (SSD), tape drives, and the like. Example computer storage media may include volatile and nonvolatile, removable and non-removable media implemented in any method or technology for storage of information, such as computer readable instructions, data structures, program modules, or other data.

The system memory 406, the removable storage devices 436 and the non-removable storage devices 438 are examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by the computing device 400. Any such computer storage media may be part of the computing device 400.

The computing device 400 may also include an interface bus 440 for facilitating communication from various interface devices (e.g., one or more output devices 442, one or more peripheral interfaces 444, and one or more communication devices 446) to the basic configuration 402 via the bus/interface controller 430. Some of the example output devices 442 include a graphics processing unit 448 and an audio processing unit 450, which may be configured to communicate to various external devices such as a display or speakers via one or more A/V ports 452. One or more example peripheral interfaces 444 may include a serial interface controller 454 or a parallel interface controller 456, which may be configured to communicate with external devices such as input devices (e.g., keyboard, mouse, pen, voice input device, touch input device, etc.) or other peripheral devices (e.g., printer, scanner, etc.) via one or more I/O ports 458. An example communication device 446 includes a network controller 460, which may be arranged to facilitate communications with one or more other computing devices 462 over a network communication link via one or more communication ports 464. The one or more other computing devices 462 may include: servers in any of the data centers 102, 202, and 302, such as servers 203 or 203'; the game clients 106, 206, 206' or 306; and management servers 101, 201, or 301; or the like, as described herein.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

The computing device 400 may be implemented in any suitable configuration, for example, as a part of a general purpose or specialized server, a server farm, a grid computing system, a computing cluster, a parallel cluster, a cloud computing center, a mainframe, or the like that includes any of the above functions. The computing device 400 may also be implemented as a personal computer including both laptop computer and non-laptop computer configurations.

Example embodiments may also include methods. These methods can be implemented in any number of ways, including the structures described herein. One such way may be by machine operations, of devices of the type described in the present disclosure. Another optional way may be for one or more of the individual operations of the methods to be performed in conjunction with one or more human operators performing some of the operations while other operations may be performed by machines. These human operators need not be collocated with each other, but each can be only with a machine that performs a portion of the program. In other examples, the human interaction can be automated such as by pre-selected criteria that may be machine automated.

Figure 5:
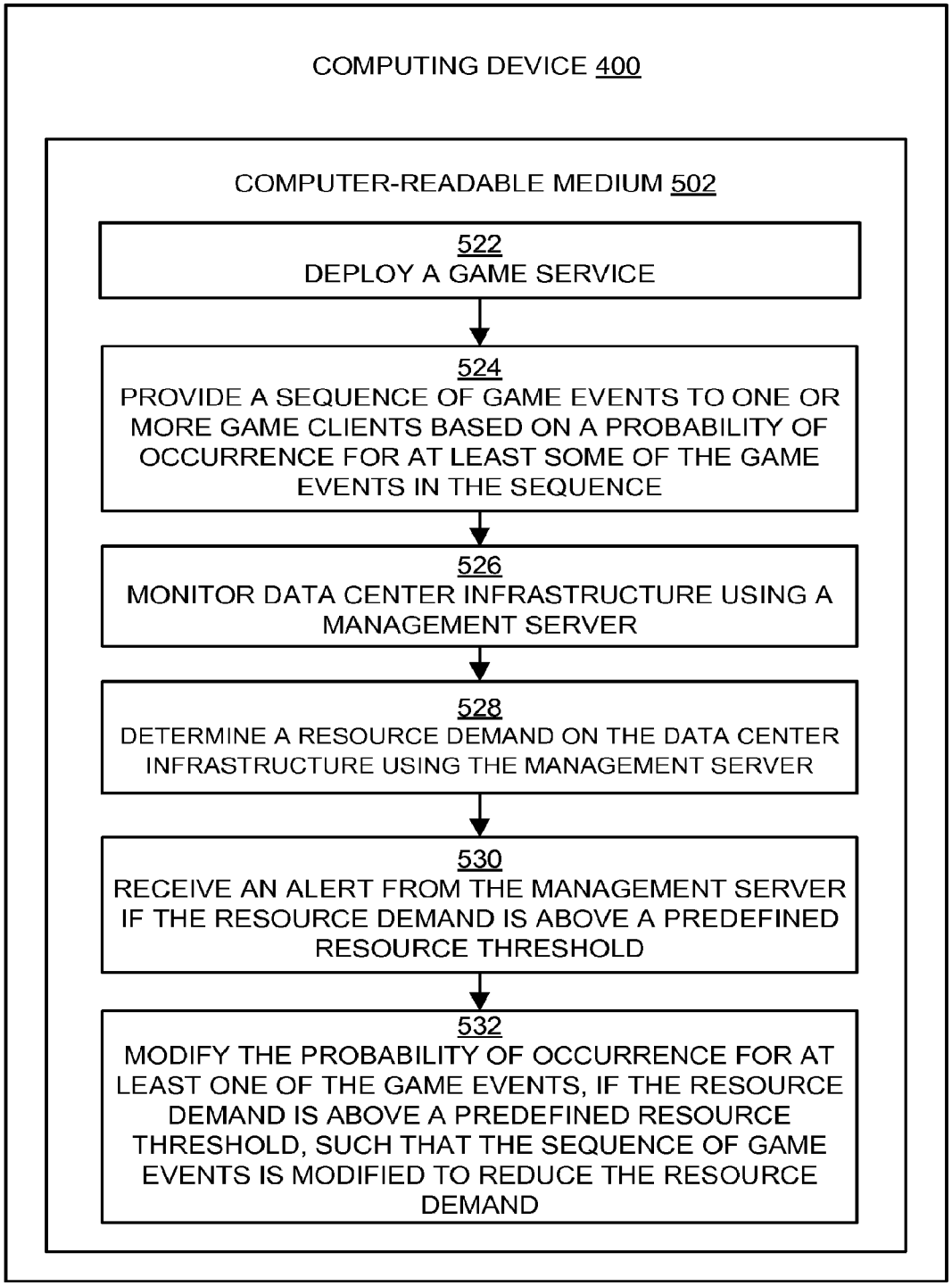
FIG. 5 is a flow diagram illustrating an example method for resource management in data center based gaming that may be performed by a computing device such as the device in FIG. 4.

FIG. 5 is a flow diagram illustrating an example method for managing data center resources for a game service that may be performed by a computing device such as the device 400 in FIG. 4, in accordance with at least some embodiments described herein. Example methods may include one or more operations, functions or actions as illustrated by blocks 522, 524, 526, 528, 530, and/or 532. The operations described in the blocks 522 through 532 may also be stored as computer-executable instructions in a computer-readable medium such as a computer-readable medium 502 of a computing device 500.

An example process for managing data center resources for a game service may begin with block 522, "DEPLOY A GAME SERVICE". For example, the data centers 102, 202, and 302 may deploy online games 104, 204, 304, 304', and the like, as described herein.

Block 522 may be followed by block 524, "PROVIDE A SEQUENCE OF GAME EVENTS TO ONE OR MORE GAME CLIENTS BASED ON A PROBABILITY OF OCCURRENCE FOR AT LEAST SOME OF THE GAME EVENTS IN THE SEQUENCE." The operation(s) at block 524 may be carried out by the data centers 102, 202, and 302 to provide the sequence of game events to one or more game clients such as the game clients 106, 206, 206', and 306, respectively. The sequence of game events and the probability of occurrence may be drawn from a database (e.g., 124 or 144). Probability of some events may be 1 (i.e. they always happen) or some events may depend on others. Game events may also be of different lengths and may include substantial plot material and duration.

Block 524 may be followed by block 526, "MONITOR DATA CENTER INFRASTRUCTURE," and block 528, "DETERMINE A RESOURCE DEMAND ON THE DATA CENTER INFRASTRUCTURE." The operations of blocks 524 and 526 may be carried out by the optional management servers, such as 101, 201, or 301. In the absence of one of the optional management servers, blocks 524 and 526 may be carried out by any of the servers in the data centers 102, 202, and 302.

Block 528 may be followed by block 530, "DETERMINE IF THE RESOURCE DEMAND IS ABOVE A PRE-DEFINED RESOURCE THRESHOLD." The operation(s) of block 530 may be carried out by a server, such as the servers in the data centers 102, 202, and 302, or by the optional management servers such as 101, 201, or 301.

Block 530 may be followed by block 532, "MODIFY THE PROBABILITY OF OCCURRENCE FOR AT LEAST ONE OF THE GAME EVENTS, SUCH THAT THE SEQUENCE OF GAME EVENTS IS MODIFIED TO REDUCE THE RESOURCE DEMAND." The operation(s) of block 532 may be carried out by a server, such as the servers in data centers 102, 202, and 302, or by the optional management servers such as 101, 201, or 301. Block 532 may include outputting the modified probability of occurrence and the modified sequence of game events to the databases. Block 532 may be followed by block 524, where the modified probability of occurrence and the modified sequence of game events are again provided to the game clients.

The operations included in the above described process are for illustration purposes. Managing data center resources for a game service may be implemented by similar processes with fewer or additional operations, for example, employing operations depicted in FIG. 1B and FIG. 1C. In some examples, the operations may be performed in a different order. In some other examples, various operations may be eliminated. In still other examples, various operations may be divided into additional operations, or combined together into fewer operations.

Figure 6:
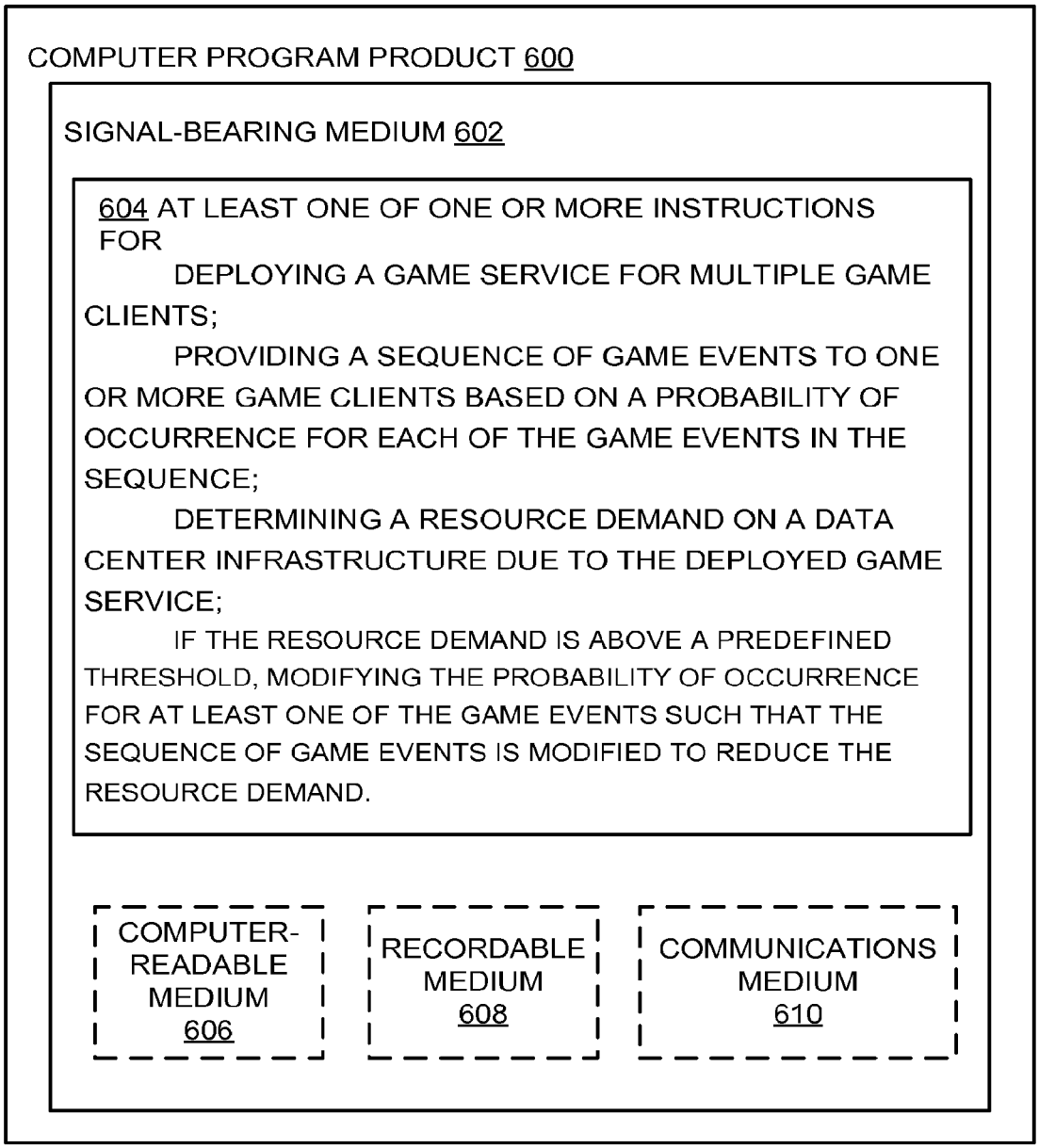
FIG. 6 is a block diagram of an example computer program product.

FIG. 6 is a block diagram of an example computer program product 600, arranged in accordance with at least some embodiments described herein. In some examples, as shown in FIG. 6, the computer program product 600 may include a signal bearing medium 602 that may also include one or more machine readable instructions 604 that, when executed by, for example, a processor, may provide the functionality described herein. Thus, for example, referring to the processor 404 in FIG. 4, one or more of the tasks shown in FIG. 6 may be undertaken in response to the instructions 604 conveyed to the processor 404 by the medium 602 to perform actions associated with managing data center resources for a game service as described herein. Some of those instructions may include, for example, "deploying a game service for multiple game clients," "providing a sequence of game events to one or more game clients based on a probability of occurrence for each of the game events in the sequence," "determining a resource demand on a data center infrastructure due to the deployed game service," and "if the resource demand is above a predefined resource threshold, modifying the probability of occurrence for at least one of the game events such that the sequence of game events is modified to reduce the resource demand" and the like, according to embodiments described herein.

In some implementations, the signal bearing medium 602 depicted in FIG. 6 may encompass a computer-readable medium 606, such as, but not limited to, a hard disk drive, a solid state drive, a Compact Disc (CD), a Digital Versatile Disk (DVD), a digital tape, memory, etc. In some implementations, the signal bearing medium 602 may encompass a recordable medium 608, such as, but not limited to, memory, read/write (R/W) CDs, R/W DVDs, etc. In some implementations, the signal bearing medium 602 may encompass a communications medium 610, such as, but not limited to, a digital and/or an analog communication medium (e.g., a fiber optic cable, a waveguide, a wired communications link, a wireless communication link, etc.). Thus, for example, the program product 600 may be conveyed to one or more modules of the processor 404 by an RF signal bearing medium, where the signal bearing medium 602 is conveyed by the wireless communications medium 610 (e.g., a wireless communications medium conforming with the IEEE 802.11 standard).

According to some examples, a method for managing data center resources for a game service is provided. The method may include: deploying a game service for multiple game clients; providing a sequence of game events to one or more game clients based on a probability of occurrence for each of the game events in the sequence; determining a resource demand on a data center infrastructure due to the deployed game service; and if the resource demand is above a predefined resource threshold, modifying the probability of occurrence for at least one of the game events such that the sequence of game events is modified to reduce the resource demand.

In various examples, the modification of the sequence of game events may be substantially undetectable to the game clients.

In some examples, the method may further include encouraging or incentivizing a game client to select a game event in the sequence such that the resource demand may be reduced as a result of the selection. In other examples, the method may further include preserving a pseudorandom nature of the sequence of game events when modifying the sequence. In various examples, the game clients may be encouraged or incentivized by a game service provider and/or a data center deploying the game service through: an in-game reward, an in-game penalty, an out-of-game reward, an out-of game-penalty, a game objective, a game scenario, a game play indicator, a game congestion indicator, and/or an inter-player communication.

In some examples, a game service provider may be incentivized to manage the resource demand by modifying the probability of occurrence for one of the game events or enable a data center deploying the game service to manage the resource demand by modifying the probability of occurrence for one of the game events. In other examples, the game events, may be distinguished by: a different game location, a different game time, a different game scenario, and/or a different subset of participating game clients.

In various examples, the method may also include determining an expected resource demand based on historical usage. If the expected resource demand is above the predefined resource threshold, the method may include: modifying the probability of occurrence for at least one of the game events, incentivizing at least one game client to select another game event in the sequence, and/or moving at least one other game client, such that the resource demand is reduced.

In some examples, the method may further include maintaining a dynamic table of occurrences indexing game events to probabilities of occurrence. In other examples, the predefined resource threshold may be a computed score.

In various examples, the resource demand may be determined based on consumption of: a memory allocation, a data storage capacity, a processing capacity, a network bandwidth, a cooling capacity, and/or a power capacity.

According to some examples, a data center configured to deploy one or more game services for multiple game clients may be provided. The data center may include a management server configured to monitor a data center infrastructure and determine a resource demand on the data center infrastructure. The data center may also include at least one server configured to: deploy a game service; provide a sequence of game events to one or more game clients based on a probability of occurrence for each of the game events in the sequence; receive an alert from the management server if the resource demand may be above a predefined resource threshold; and modify the probability of occurrence for at least one of the game events, if the resource demand may be above a predefined resource threshold, such that the sequence of game events may be modified to reduce the resource demand.

In various examples of the data center, the modification of the sequence of game events may be substantially undetectable to the game clients.

In some examples of the data center, at least one of the servers may be further configured to: encourage or incentivize a game client to select a game event in the sequence such that the resource demand may be reduced as a result of the selection.

In other examples of the data center, at least one of the servers may be further configured to: preserve a pseudorandom nature of the sequence of game events when modifying the sequence.

In various examples of the data center, the game clients may be encouraged or incentivized through: an in-game reward, an in-game penalty, an out-of-game reward, an out-of game-penalty, a game objective, a game scenario, a game play indicator, a game congestion indicator, and/or an inter-player communication.

In some examples of the data center, the at least one server may be further configured to incentivize a game service provider to manage the resource demand by modifying the probability of occurrence for one of the game events or enable a data center deploying the game service to manage the resource demand by modifying the probability of occurrence for one of the game events.

In other examples of the data center, the game events may be distinguished by: a different game location, a different game time, a different game scenario, and/or a different subset of participating game clients.

In various examples of the data center, the management server may be further configured to determine an expected resource demand based on historical usage. In some examples of the data center, if the expected resource demand is above the predefined resource threshold, the at least one server may be further configured to: modify the probability of occurrence for at least one of the game events, incentivize at least one game client to select another game event in the sequence, and/or move at least one other game client, such that the resource demand is reduced. A game service provider may be incentivized to enable the data center deploying the game service to manage the resource demand by modifying the probability of occurrence for the at least one of the game events In various examples of the data center, at least one of the servers may be further configured to maintain a dynamic table of occurrences indexing game events to probabilities of occurrence.

In some examples of the data center, the predefined resource threshold may be a computed score.

In other examples of the data center, the resource demand may be determined based on consumption of: a memory allocation, a data storage capacity, a processing capacity, a network bandwidth, a cooling capacity, and/or a power capacity.

In various examples of the data center, the data center may be configured to deploy multiple game services from multiple game vendors and the at least one server may be further configured to employ an event occurrence application programming interface (API) to modify the probability of occurrence.

In some examples of the data center, the management server may be further configured to provide incentives to the game vendors to provide the event occurrence API and multiple game sequence options associated with different levels of resource consumption.

In other examples of the data center, the management server may be further configured to enable the game vendors to update the event occurrence API in order to provide probabilities of occurrence for additional game events.

In various examples of the data center, the data center may be configured to deploy the game service in a zone-oriented architecture and the management server may be further configured to: determine a first resource demand for a first zone server and a second resource demand for a second zone server; and if the first resource demand exceeds the second resource demand, modify the probability of occurrence for at least one of the game events such that the sequence may shift from the first zone server to the second zone server.

According to some examples, a computer-readable medium with instructions stored thereon for managing data center resources for a game service is provided. The instructions may include: deploying a game service for multiple game clients; providing a sequence of game events to one or more game clients based on a probability of occurrence for each of the game events in the sequence; determining a resource demand on a data center infrastructure due to the deployed game service; and if the resource demand is above a predefined resource threshold, modifying the probability of occurrence for at least one of the game events such that the sequence of game events may be modified to reduce the resource demand.

In various examples of the computer-readable medium, the modification of the sequence of game events may be substantially undetectable to the game clients.

In some examples of the computer-readable medium, the instructions may further include: encouraging or incentivizing a game client to select a game event in the sequence such that the resource demand is reduced as a result of the selection.

In other examples of the computer-readable medium, the instructions may also include preserving a pseudorandom nature of the sequence of game events when modifying the sequence.

In various examples of the computer-readable medium, the game clients may be encouraged or incentivized by a game service provider and/or a data center deploying the game service through: an in-game reward, an in-game penalty, an out-of-game reward, an out-of game-penalty, a game objective, a game scenario, a game play indicator, a game congestion indicator, and/or an inter-player communication.

In some examples of the computer-readable medium, the game service provider may be incentivized to manage the resource demand by modifying the probability of occurrence for one of the game events or enable a data center deploying the game service to manage the resource demand by modifying the probability of occurrence for one of the game events.

In other examples of the computer-readable medium, the game events may be distinguished by: a different game location, a different game time, a different game scenario, and/or a different subset of participating game clients.

In various examples of the computer-readable medium, the instructions may also include determining an expected resource demand based on historical usage. In some examples, if the expected resource demand is above the predefined resource threshold, the instructions may further include: modifying the probability of occurrence for at least one of the game events, incentivizing at least one game client to select another game event in the sequence, and/or moving at least one other game client, such that the resource demand is reduced.

In other examples of the computer-readable medium, the instructions may also include maintaining a dynamic table of occurrences indexing game events to probabilities of occurrence.

In various examples of the computer-readable medium, the predefined resource threshold may be a computed score.

In various examples of the computer-readable medium, the resource demand may be determined based on consumption of: a memory allocation, a data storage capacity, a processing capacity, a network bandwidth, a cooling capacity, and/or a power capacity.

According to some examples, a game vendor server may be configured to deploy a game service for multiple game clients. The game vendor server may include a memory configured to store instructions, and a processor configured to execute a game application in conjunction with the instructions stored in the memory. The game application may be configured to: provide a sequence of game events to one or more game clients based on a probability of occurrence for each of the game events in the sequence; monitor a resource demand server due to the deployed game service; and if the resource demand is above a predefined resource threshold: modify the probability of occurrence for at least one of the game events, incentivize a game client to select a game event in the sequence, and/or move a game client to a different game instance, such that the resource demand is reduced while preserving a pseudorandom nature of the sequence of game events.

In various examples of the game vendor server, the modification of the sequence of game events may be substantially undetectable to the game clients.

In some examples of the game vendor server, the game clients may be incentivized through: an in-game reward, an in-game penalty, an out-of-game reward, an out-of game-penalty, a game objective, a game scenario, a game play indicator, a game congestion indicator, and/or an inter-player communication.

In other examples of the game vendor server, the game events may be distinguished by: a different game location, a different game time, a different game scenario, and/or a different subset of participating game clients.

There is little distinction left between hardware and software implementations of aspects of systems; the use of hardware or software is generally (but not always, in that in certain contexts the choice between hardware and software may become significant) a design choice representing cost vs. efficiency tradeoffs. There are various vehicles by which processes and/or systems and/or other technologies described herein may be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples may be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, may be equivalently implemented in integrated circuits, as one or more computer programs running on one or more computers (e.g., as one or more programs running on one or more computer systems), as one or more programs running on one or more processors (e.g. as one or more programs running on one or more microprocessors), as firmware, or as virtually any combination thereof, and that designing the circuitry and/or writing the code for the software and or firmware would be well within the skill of one of skill in the art in light of this disclosure.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular sensors, computing devices, components, networks, or data center environments, which can, of course, vary. It is also to be understood that the terminology used herein is for the purpose of describing particular embodiments only, and is not intended to be limiting.

In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Versatile Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein may be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity of gantry systems; control motors for moving and/or adjusting components and/or quantities).

A typical data processing system may be implemented utilizing any suitable commercially available components, such as those typically found in data computing/communication and/or network computing/communication systems. The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediate components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically connectable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application.

The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method to manage data center resources for a game service, the method comprising:

deploying the game service for a plurality of game clients;

providing a sequence of game events to the game clients based on a probability of occurrence for the game events in the sequence;

determining a resource demand on a data center infrastructure due to the deployed game service;

if the resource demand is above a predefined resource threshold, modifying the probability of occurrence for at least one of the game events such that the sequence of game events is modified to reduce the resource demand; and one of encouraging or incentivizing at least one of the game clients to select a game event in the sequence such that the resource demand is reduced as a result of the selection.

2. The method of claim 1, wherein the modification of the sequence of game events is substantially undetectable to the game clients.

3. The method of claim 1, further comprising:

preserving a pseudorandom nature of the sequence of game events when modifying the sequence.

4. The method of claim 1, wherein the game clients are one of encouraged or incentivized by one of a game service provider and/or a data center deploying the game service through one or more of: an in-game reward, an in-game penalty, an out-of-game reward, an out-of game-penalty, a game objective, a game scenario, a game play indicator, a game congestion indicator, and an inter-player communication.

5. The method of claim 1, further comprising:

incentivizing a game service provider to one of:

manage the resource demand by modifying the probability of occurrence for the at least one of the game events; or enable a data center deploying the game service to manage the resource demand by modifying the probability of occurrence for the at least one of the game events.

6. The method of claim 1, wherein the game events are distinguished by one or more of: a different game location, a different game time, a different game scenario, and/or a different subset of participating game clients.

7. The method of claim 1, further comprising:

determining an expected resource demand based on historical usage; and if the expected resource demand is above the predefined resource threshold, one or more of:

modifying the probability of occurrence for at least one of the game events, incentivizing the at least one of the game clients to select another game event in the sequence, and incentivizing a game service provider to enable a data center deploying the game service to manage the resource demand by modifying the probability of occurrence for the at least one of the game events, such that the resource demand is reduced.

8. A data center configured to deploy a game service for a plurality of game clients, the data center comprising:

a management server configured to:

monitor a data center infrastructure; and determine a resource demand on the data center infrastructure; and at least one server configured to:

deploy the game service;

provide a sequence of game events to the game clients based on a probability of occurrence for the game events in the sequence;

receive an alert from the management server if the resource demand is above a predefined resource threshold;

modify the probability of occurrence for at least one of the game events, if the resource demand is above a predefined resource threshold, such that the sequence of game events is modified to reduce the resource demand; and preserve a pseudorandom nature of the sequence of game events when modifying the probability of occurrence.

9. The data center of claim 8, wherein at least one of the servers is further configured to:

one of encourage or incentivize at least of the game clients to select a game event in the sequence such that the resource demand is reduced as a result of the selection.

10. The data center of claim 8, wherein at least one of the servers is further configured to:

maintain a dynamic table of occurrences indexing game events to probabilities of occurrence.

11. The data center of claim 8, wherein the predefined resource threshold is a computed score.

12. The data center of claim 8, wherein the resource demand is determined based on consumption of one or more of: a memory allocation, a data storage capacity, a processing capacity, a network bandwidth, a cooling capacity, and a power capacity.

13. The data center of claim 8, wherein the data center is configured to deploy a plurality of game services from a plurality of game vendors and the at least one server is further configured to employ an event occurrence application programming interface (API) to modify the probability of occurrence.

14. The data center of claim 13, wherein the management server is further configured to provide incentives to the plurality of game vendors to provide the event occurrence API and a plurality of game sequence options associated with different levels of resource consumption.

15. The data center of claim 13, wherein the management server is further configured to enable the plurality of game vendors to update the event occurrence API in order to provide probabilities of occurrence for additional game events.

16. The data center of claim 8, wherein the data center is configured to deploy the game service in a zone-oriented architecture and the management server is further configured to:

determine a first resource demand for a first zone server and a second resource demand for a second zone server; and if the first resource demand exceeds the second resource demand, modify the probability of occurrence for at least one of the game events such that the sequence shifts from the first zone server to the second zone server.

17. A game vendor server configured to deploy a game service for a plurality of game clients, the game vendor server comprising:

a memory configured to store instructions; and a processor configured to execute a game application in conjunction with the instructions stored in the memory, the game application configured to:

provide a sequence of game events the game clients based on a probability of occurrence for the game events in the sequence;

monitor a resource demand server due to the deployed game service; and if the resource demand is above a predefined resource threshold, one or more of: modify the probability of occurrence for at least one of the game events, incentivize at least one of the game client to select a game event in the sequence, and move at least one of the game client to a different game instance, such that the resource demand is reduced while preserving a pseudorandom nature of the sequence of game events.

18. The game vendor server of claim 17, wherein the modification of the sequence of game events is substantially undetectable to the game clients.

19. The game vendor server of claim 17, wherein the game clients are incentivized through one or more of: an in-game reward, an in-game penalty, an out-of-game reward, an out-of game-penalty, a game objective, a game scenario, a game play indicator, a game congestion indicator, and an inter-player communication.

20. The game vendor server of claim 17, wherein the game events are distinguished by one or more of: a different game location, a different game time, a different game scenario, and/or a different subset of participating game clients.

* * * * *

UNITED STATES PATENT AND TRADEMARK OFFICE

CERTIFICATE OF CORRECTION

PATENT NO. : 8,790,184 B2
APPLICATION NO. : 13/634502
DATED : July 29, 2014
INVENTOR(S) : Kruglick It is certified that error appears in the above-identified patent and that said Letters Patent is hereby corrected as shown below:

In the Specification

In Column 7, Line 4, delete “center 200” and insert -- center 202 --, therefor.

In Column 7, Line 33, delete “center 200” and insert -- center 202 --, therefor.

In Column 13, Line 10, delete “events” and insert -- events. --, therefor.

In Column 15, Line 50, delete “and or” and insert -- and/or --, therefor.

In the Claims

In Column 20, Line 22, in Claim 17, delete “events” and insert -- events to --, therefor.

In Column 20, Line 30, in Claim 17, delete “client” and insert -- clients --, therefor.

In Column 20, Line 32, in Claim 17, delete “client” and insert -- clients --, therefor.

Signed and Sealed this
Eleventh Day of November, 2014

Michelle K. Lee

Michelle K. Lee
*Deputy Director of the United States Patent and Trademark Office*